US009768005B1

(12) United States Patent
He et al.

(10) Patent No.: US 9,768,005 B1
(45) Date of Patent: Sep. 19, 2017

(54) ELECTROSPRAY IONIZER FOR MASS SPECTROMETRY OF AEROSOL PARTICLES

(71) Applicants: MSP Corporation, Shoreview, MN (US); Regents of the University of Minnesota, Minneapolis, MN (US)

(72) Inventors: Siqin He, Qianjiang (CN); Chris Hogan, Minneapolis, MN (US); Lin Li, Arden Hills, MN (US); Benjamin Y. H. Liu, North Oaks, MN (US); Amir Naqwi, Eden Prairie, MN (US); Francisco Romay, Vadnais Heights, MN (US)

(73) Assignees: MSP Corporation, Shoreview, MN (US); Regents of the University of Minnesota, Minneapolis, MN (US)

( * ) Notice: Subject to any disclaimer, the term of this patent is extended or adjusted under 35 U.S.C. 154(b) by 0 days.

(21) Appl. No.: 15/135,132

(22) Filed: Apr. 21, 2016

Related U.S. Application Data

(60) Provisional application No. 62/150,580, filed on Apr. 21, 2015.

(51) Int. Cl.
*H01J 49/16* (2006.01)
*H01J 49/40* (2006.01)

(52) U.S. Cl.
CPC ..... *H01J 49/165* (2013.01); *H01J 49/167* (2013.01); *H01J 49/40* (2013.01)

(58) Field of Classification Search
None
See application file for complete search history.

(56) References Cited

U.S. PATENT DOCUMENTS 5,945,678 A * 8/1999 Yanagisawa ..... H01J 49/168 250/287
7,882,799 B2 * 2/2011 Dick ..... H01L 21/67028 118/308
8,450,682 B2 * 5/2013 Hiraoka ..... H01J 49/0459 250/288

OTHER PUBLICATIONS

Gallimore et al. "Characterizing an Extractive Electrospray Ionization (EESI) Source for the Online Mass Spectrometry Analysis of Organic Aerosols." Environmental Science & Technology, 2013, 47, 7324-7331.
Grimm et al. "Probing interfacial chemistry of single droplets with field-induced droplet ionization mass spectrometry: physical adsorption of polycyclic aromatic hydrocarbons, and ozonolysis of oleic acid and related compounds." Analytical Chemistry, 2006, 78, 3800-3806.

(Continued)

*Primary Examiner* — Jack Berman
(74) *Attorney, Agent, or Firm* — Westman, Champlin & Koehler, P.A.; Z. Peter Sawicki; Amanda M. Prose

(57) ABSTRACT

A device and method are disclosed to apply ESI-based mass spectroscopy to submicrometer and nanometer scale aerosol particles. Unipolar ionization is utilized to charge the particles in order to collect them electrostatically on the tip of a tungsten rod. Subsequently, the species composing the collected particles are dissolved by making a liquid flow over the tungsten rod. This liquid with dissolved aerosol contents is formed into highly charged droplets, which release unfragmented ions for mass spectroscopy, such as time-of-flight mass spectroscopy. The device is configured to operate in a switching mode, wherein aerosol deposition occurs while solvent delivery is turned off and vice versa.

17 Claims, 7 Drawing Sheets

(56) References Cited

OTHER PUBLICATIONS

Horan et al. "Online Characterization of Particles and Gases with an Ambient Electrospray Ionization Source." Analytical Chemistry, 2012, 84, 9253-9258.
Peng et al. "Electrospray-assisted laser desorption/ionization and tandem mass spectrometry of peptides and proteins." Rapid Communications in Mass Spectrometry, 2007, 21, 2541-2546.
Shia et al. "Synthesis, crystal structure, insecticidal activity and DFT study on the geometry and vibrations of O-(E)-1-{1-[(6-chloropyridin-3-yl)methyl]-5-methyl-1H-1,2,3-triazol-4-yl}ethyleneamino-O-ethyl-O-phenylphosphorothioate." Spectrochimica Acta Part A, 2008, 71, 1011-1020.

* cited by examiner

ELECTROSPRAY IONIZER FOR MASS SPECTROMETRY OF AEROSOL PARTICLES

CROSS-REFERENCE TO RELATED APPLICATION

The present application claims priority to U.S. Provisional Patent Application No. 62/150,580, filed on Apr. 21, 2015, and entitled "ELECTROSPRAY IONIZER FOR MASS SPECTROMETRY OF AEROSOL PARTICLES", the disclosure of which is incorporated by reference in its entirety.

GOVERNMENT RIGHTS

This invention was made with government support under DE-SC0013302 awarded by the US Department of Energy. The government has certain rights in the invention.

BACKGROUND

Time-of-flight mass spectrometry for the measurement of molecular masses of compounds requires ionization of the molecules, which can be accomplished using a variety of techniques. Electrospray ionization (ESI) is a particularly advantageous ionization technique as it ionizes fragile molecules without fragmentation by generating highly-charged liquid drops of the analyte solution, which subsequently release ionized molecules of the analyte. Hence, ESI is referred to as a "soft ionization" technique that has enabled mass spectrometric measurement of organic ions and macromolecules, which would otherwise be difficult to ionize in the gas phase without substantial ion fragmentation.

ESI is particularly well suited for mass spectroscopy of proteomics and metabolomics. ESI is also suitable for certain analytes in ambient aerosol particles, though it has been difficult to utilize ESI in this application. Ambient aerosol particles are of considerable interest for mass spectroscopy due to their effect on human health and atmospheric visibility. They are also of interest due to their influence on radiative forcing, which is pertinent to the assessment of the global climate change. The chemical composition of such particles is difficult to analyze, as they persist in the atmosphere at mass concentrations of 10 micrograms per cubic meter or less in many environments. Nonetheless, analyses of particle chemical compositions have been attempted both in ambient field studies and in simulated laboratory environments via Aerosol Mass Spectrometers (e.g. the commercially available AMS from Aerodyne Research Inc. of Billerica, Mass.). In these instruments, particles are deposited on a surface, the surface is heated to evaporate the particle contents, and electron ionization (EI) is subsequently used to ionize the gas-phase molecules. EI is a "hard ionization" technique. The combination of thermal volatilization and EI results in fragmentation of large molecules, which cannot be measured directly using the current AMS devices. An alternative technique, the thermal desorption chemical ionization mass spectrometer (TDCIMS), utilizes chemical ionization (CI) instead of EI. However, direct measurement of completely unfragmented/unreacted species is not enabled.

ESI based mass spectroscopy for aerosol has so far been performed off-line, which involves collecting particles (submicrometer in size) for long periods of time onto filters and subsequently extracting and analyzing them in a laboratory. This process is labor-intensive, time-consuming, and precludes real-time measurements. In an attempt to develop a real-time technique facilitating ESI-like ion production for species within ambient aerosol particles, Grimm et al. (2006) showed that the ESI can be performed directly from droplets in the gas phase (i.e. field induced droplet dissociation), giving rise to ESI type ions directly from aerosol droplets. However, the technique is limited to large (>100 microns) liquid drops, prohibiting its application for measurements of smaller micrometer and submicrometer particles. Peng et al. (2007) demonstrated that proteins, introduced into the gas phase via matrix assisted laser desorption ionization (MALDI), could be uptaken into ESI generated droplets, and subsequently released from droplets as multiply charged ions through mixing an ESI generated droplet plume with a MALDI generated analyte plume (i.e. analytes were incorporated into droplets via droplet-analyte coagulation). Similarly, Shia et al (2008) showed that biomolecules (aerosolized via either laser desorption or by an ultrasonic nebulizer) could be collisionally incorporated into ESI like droplets, resulting in the eventual formation of multiply charged ESI-like biomolecular ions (these approaches are referred to as "extractive ESI").

While these studies demonstrate the capture of aerosol particles by ESI generated droplets and subsequent ionization, unfortunately, these techniques are limited by collision kinetics between ESI droplets and aerosol particles. Calculations of particle collision rates demonstrate that gas phase based collision approaches require a high number concentration of aerosol particles needed to generate a sufficient number of ions for mass analysis. Hence, they are not suitable for ambient aerosol.

Recently, Horan et al. (2012) as well as Gallimore & Kalberer (2013) demonstrated that by colliding aerosol particles not with ESI generated droplets, but instead directly with the liquid cone of a stably operating electrospray, aerosol particles can be dissolved within the ESI solution and hence ionized. Because of the significantly larger collision length (for diffusive capture of aerosol particles) of the electrospray liquid cone as compared to droplets, such systems are a more promising route to the production of ESI-type, unfragmented ions from aerosol particles than either field induced droplet ionization or extractive ESI. However, the lower limit of detection is still high due to the poor collection efficiency.

SUMMARY

An aspect of the present disclosure relates to a system for applying Electrospray ionization, hereinafter referred to as "ESI", to submicrometer and nanometer scale aerosol particles. The particles are charged by utilizing unipolar ionization and electrostatic precipitation, which allows for collecting the particles on the tip of a tungsten rod. Subsequently, by flowing a liquid over the rod, dissolution of the species composing the collected particles occurs. This liquid with dissolved aerosol contents is formed into highly charged droplets, which release unfragmented ions. The system overcomes the concentration limitations of the prior art approaches by electrostatically depositing particles onto an ESI tip. Sensitivity can be further enhanced by collecting particles for a prescribed period of time and subsequently using ESI for ionization of the particle contents.

Another aspect of the present disclosure relates to a Charged Aerosol ElectroSpray Ionizer (hereinafter "CAESI"), which is a technique for generating ions from molecules in aerosol particles by bringing electrically charged aerosols to the electrospray tip. In one embodiment, the technique is a two-step switching type technique. Aerosol particles are charged, and deposited on approximately a <20 square millimeter area spot on a metal rod by a combination of diffusion and electrophoretic motion in the gas phase. Subsequently, aerosol flow to the rod is turned off, flow of a solvent is started and high voltage is applied. When aerosol flow to the rod is switched on, the flow of the solvent is turned off Thus a stable electrospray is formed over the tip of the metal rod. Molecules from the aerosol particles dissolve in the flowing liquid and are released as unfragmented ions from ESI generated droplets.

Both polydisperse and monodisperse aerosol particles in the approximately 20 nm to approximately 2.5 micron size range can be used with the CAESI. CAESI according to the present disclosure can be used to detect aerosol analytes down to nanograms of collected material with dynamic range of roughly five orders of magnitude in collected mass, making CAESI usable for analysis of size-classified particle fractions, as well as unclassified polydisperse particles sampled in field measurements. The integrated signal intensity during measurement is a monotonic function of the collected analyte mass, and that the absolute signal measured (at a given instant) is a function of the deposited analyte mass remaining on the rod.

DETAILED DESCRIPTION

Figure 1:
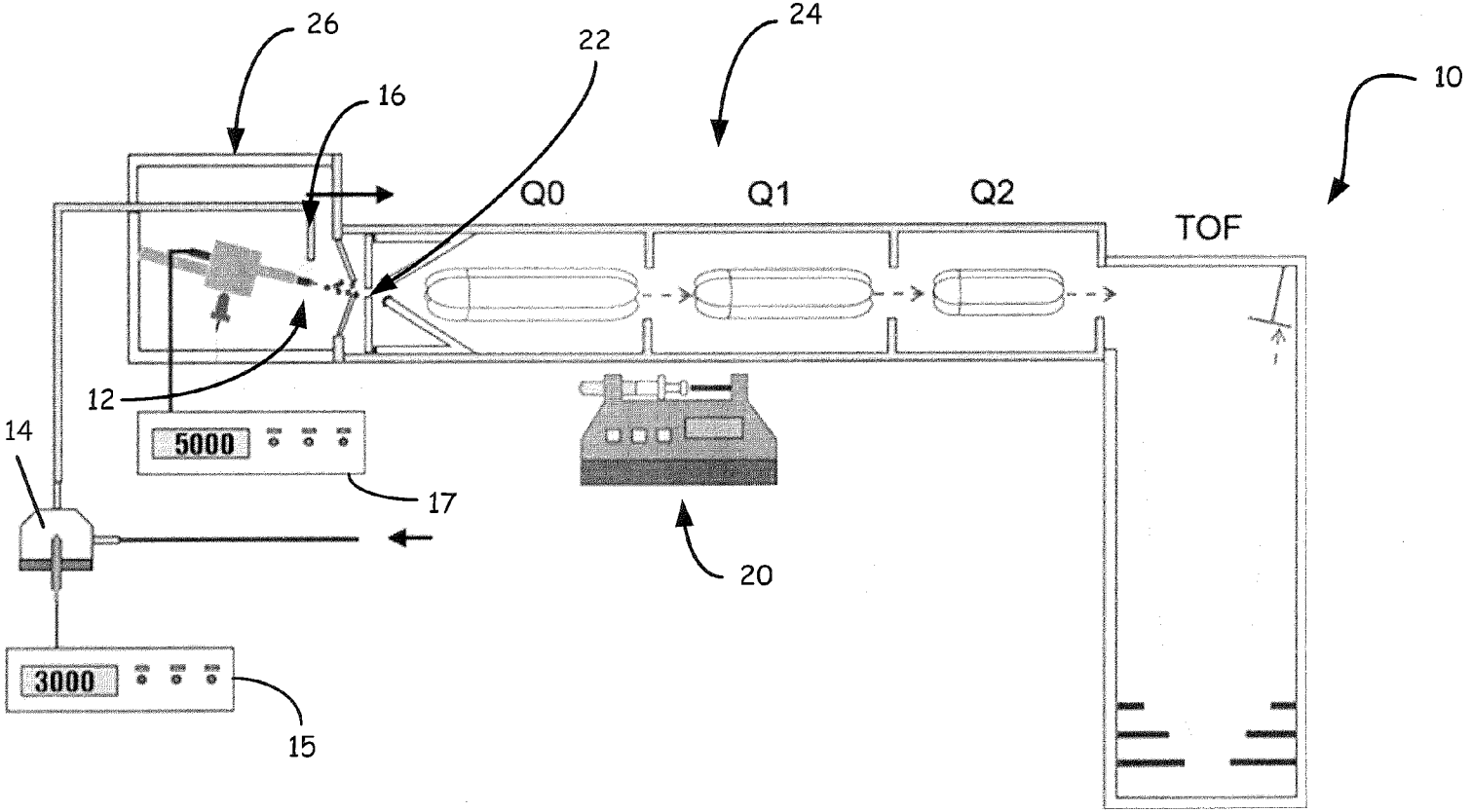
FIG. 1 is a schematic representation of CAESI system together with a mass spectrometer for real-time chemical analysis of aerosol particles.
Figure 2A:
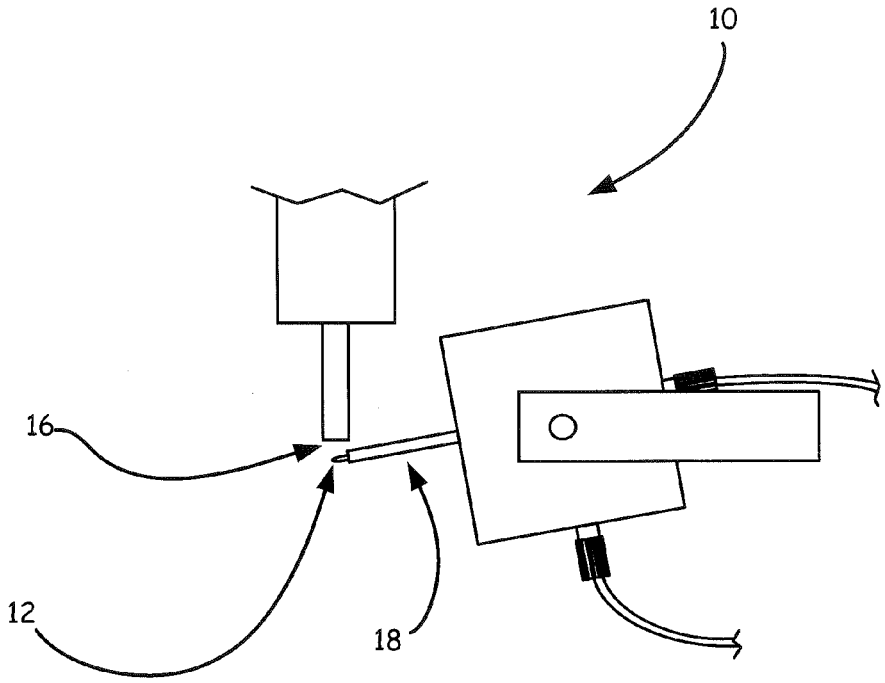
FIG. 2A is a front perspective view of the front-end of CAESI.
Figure 2B:
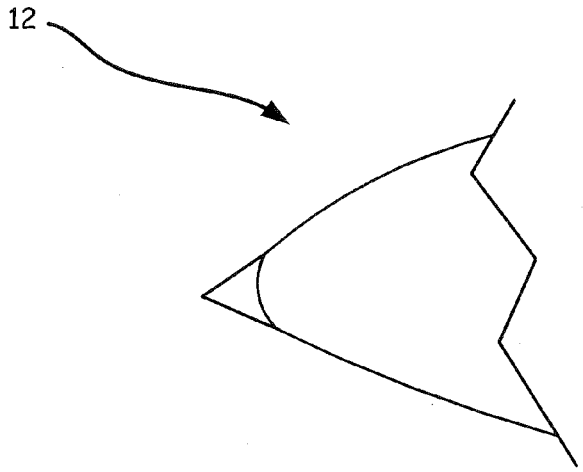
FIG. 2B is a magnified view of the tip of the collection rod, where electrospray liquid cone is formed.

FIG. 1 is a schematic of an embodiment of CAESI system 10 and a collection rod 12 of CAESI is shown in FIGS. 2A and 2B. Operating the CAESI System 10 for particle collection, dissolution, ion production, and mass measurement includes a flow of particle-laden air being pulled at a flow rate of approximately 0.5-1.0 liters/min into an ionization chamber 14, for example, a "Corona-discharge Unipolar Ionization Chamber". The chamber 14 is employed to electrically charge aerosol particles and may be connected to a high voltage power supply 15, so the particles can be electrostatically deposited onto a collection rod 12. In the ionization chamber 14, ions are generated via corona discharge which is created by application of a high voltage, for example, 3 kV, to an approximately 1/16" diameter tungsten needle, which may be tapered at its edge for electric field enhancement. While the polarity of the ions generated is controllable, it may be beneficial to ions of one polarity only, for example the use of positive ions only. Positive corona discharges are found to be more stable than negative corona discharges, which often exhibit significant fluctuations in the ion current. Airborne ions readily attach to aerosol particles. Loss of charged particles in the ionization chamber can be minimized by controlling the airflow rate.

Subsequent to the ionization chamber 14, the sampled aerosol is passed through a nozzle 16 as illustrated in FIG. 2. The nozzle 16 is a small diameter nozzle, having an approximately 1/32" inner diameter and is comprised of stainless steel. Deposition of particles onto the collection rod 12, which may be a tungsten rod having a diameter of approximately 1/16", is facilitated by a negative voltage (typically approximately −4 kV) applied to the rod 12 by a second high voltage power source 17, while the nozzle 16 is kept grounded. The rod 12 is sheathed with a plastic (PEEK) tube 18, such that only a rounded end is exposed to the aerosol, allowing all particles to be deposited onto a small surface area (approximately ~0.16 $cm^2$).

Particle charging and collection proceeds for a selected period of time ranging from approximately 5 minutes to 60 minutes, after which the aerosol is no longer sampled, and the polarity of the voltage applied to the tungsten rod 12 is flipped to positive 7 kV.

Simultaneously, the rod 12 is positioned close to an inlet 22 of a mass spectrometer 24 (for example, the mass spectrometer 24 is a time-of-flight mass spectrometer with an ionization source such as a QSTAR XL mass spectrometer from Applied Biosystems, Waltham, Mass., USA with the CAESI chamber built via modification of a QSTAR XL IonSpray source) and a flow of liquid solution, controlled via a syringe pump 20 (Harvard apparatus) at approximately 25 microliters per minute is driven over the rod 12. As the liquid passes over the rod 12, the soluble content of the deposited aerosol particles is dissolved in the liquid and the high voltage applied to the rod 12 leads to the formation of a liquid cone at the rod tip 12, as shown in FIG. 2B. A fine liquid jet issues from the tip of the liquid cone and breaks up into highly charged fine droplets. As these droplets shrink by evaporation of the liquid content, the charge is concentrated on the molecules of the dissolved content leading to "soft ionization" (as opposed to "hard ionization" resulting from EI and CI) of the unfragmented molecules, which are then drawn into the mass spectrometer for identification through the measurement of mass-to-charge ratio.

The solution used for ESI can be tuned to target the ionization of specific analytes or to specifically prevent dissolution of species not of interest. The collection of mass spectra with high mass resolving power for generated ions then enables chemical (molecular) identification of the collected species, with the temporal evolution of measured signal dependent upon the dissolution of collected molecules into the chosen solvent.

EXAMPLES

In preliminary evaluation, a CAESI chamber 26 was attached to the mass spectrometer 24 to examine electrospray ionization of material deposited on the collection rod 12. Polydisperse particles were either sent directly into the CAESI chamber or were first sent into a DMA to select either an 80 nm or a 100 nm monodisperse sample as reflected in FIGS. 3A, 3B and 3C. In both instances, particles were sent through the ionization chamber, 14 operated with 0.5 microampere current at 0.5 liters per minute, which was also the deposition flowrate. Three different types of test particles were used.

Test Particles

First, cesium iodide (CsI) particles were generated by nebulizing aqueous CsI with a Collison nebulizer and then drying out the droplets using a silica gel diffusion dryer.

Second, levoglucosan (Sigma Aldrich) particles were produced via Collison nebulization and diffusion drying of an aqueous levoglucosan solution (3-10 mM). Again, both polydisperse and DMA-selected monodisperse particles were examined.

Finally, 3 mM aqueous levoglucosan was mixed with carbon nanoparticles (Sigma Aldrich, <500 nm), and the resulting suspension was nebulized and dried. In this final instance, polydisperse particles were examined, and the DMA was used to selected monodisperse particles with a mean diameter of 80 nm only.

Example 1

Particle collection in the CAESI system proceeded for selected times ranging from 5-60 minutes. After the selected collection time, the CAESI chamber 26 was sealed from the particle source, and the polarity of the collection rod 12 was switched from negative to positive and it was repositioned near the mass spectrometer inlet. The optimal rod position was determined earlier by maximizing the signal intensity using a standard ESI solution. To facilitate ESI of aerosol content, the cylindrical sheath tube 18, surrounding the collection rod 12, was connected to a solvent feed with the pumping rate precisely controlled by a syringe pump 20. For aerosol particle measurements, the solvent composition was selected to target specific analytes within the deposited particles. For $Cs^+$ and $(CsI)_nCs^+$ ions released from CsI particles, 1 M acetic acid in methanol was used, while for levoglucosan 10 mM NaCl 95:5 methanol:water was employed. The latter was shown previously to lead to the production of the levogluson-$Na^+$ ion in ESI. In all instances, the solvent flowrate was 25 microliters per minute, necessary to maintain a stable electrospray over the collection rod.

Figures 3A, 3B, 3C:
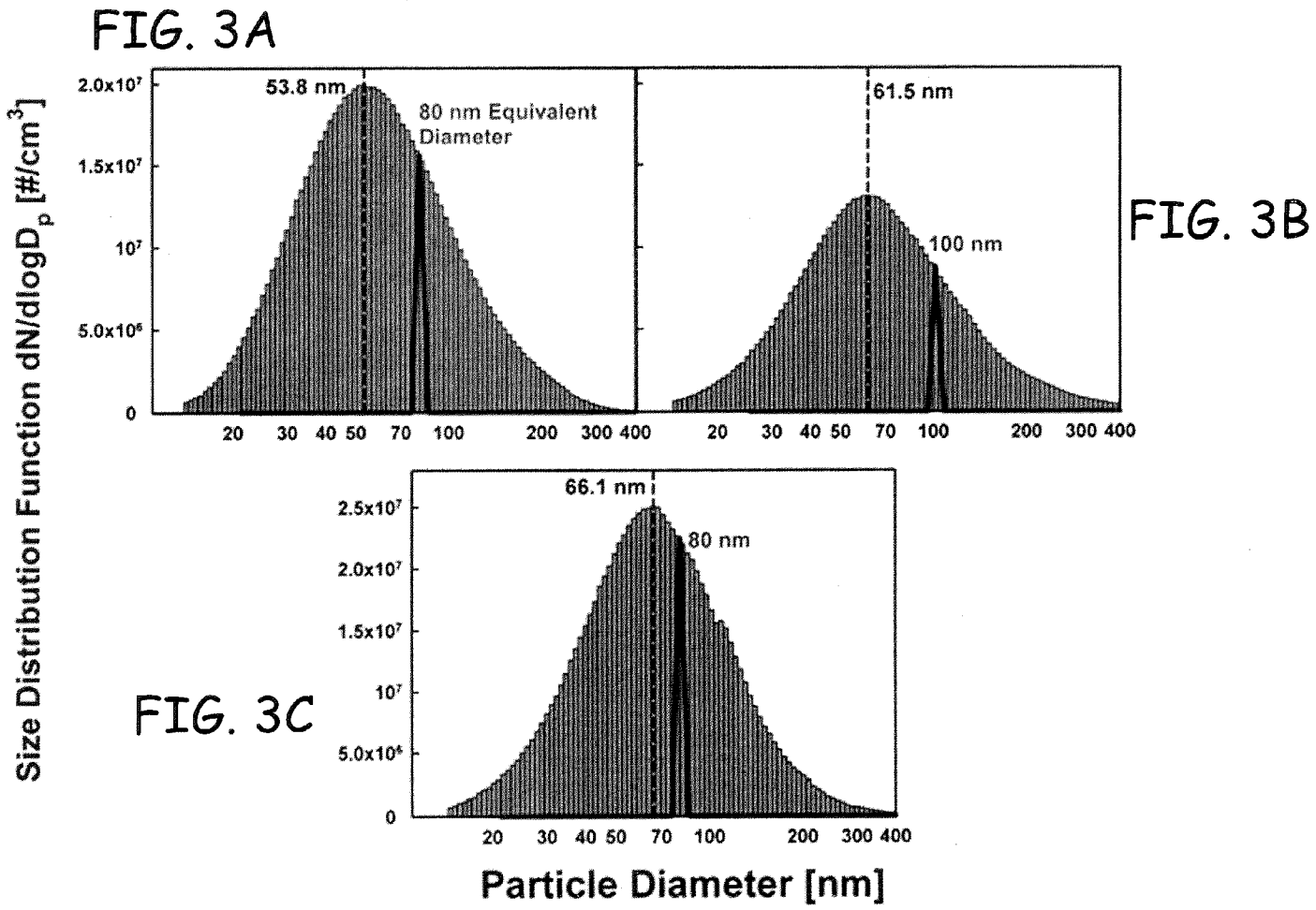
FIG. 3A illustrates a size distribution function of test aerosol particles of cesium iodide wherein mode diameters in distributions are labelled and solid lines illustrate the approximate transmission windows of a differential mobility analyzer (DMA) set to transmit 80 nm singly charged particles.
FIG. 3B illustrates a size distribution function of test aerosol particles of levoglucosan wherein mode diameters in distributions are labelled and solid lines illustrate the approximate transmission windows of a differential mobility analyzer (DMA) set to transmit 100 nm singly charged particles.
FIG. 3C is size distribution function of test aerosol particles of levoglucosan mixed with carbon nanoparticles which were used in challenging the CAESI-MS system. Mode diameters in distributions are labelled and solid lines illustrate the approximate transmission windows of a differential mobility analyzer (DMA) set to transmit 80 nm singly charged particles.

FIGS. 3A-C illustrates the size distribution functions for CsI particles (20 mM in water), levoglucosan (3 mM in water), and levoglucosan mixed carbon nanoparticles (3 mM levoglucson with 10 mM on an elemental carbon basis) respectively. All the particles were produced by nebulization. These distributions were measured using a DMA and a condensation particle counter ("CPC") in series as a scanning electrical mobility spectrometer. The distribution function dN/d log $D_p$, plotted in FIG. 3, can be integrated in a particular log diameter range to obtain the number concentration of particles in that specific range in particles per cubic centimeter. The mode diameters in distributions are marked on the plots. Also displayed on the plots are approximate mobility classification "windows" for particles transmitted through a DMA when set to transmit particles with the noted mobility equivalent diameter (i.e. spherical, singly charged particles). By use or omission of the DMA, the CAESI-MS system is challenged with monodisperse or polydisperse particles respectively.

At time T=0 minutes, 7 kV was applied to the collection rod 12 and the flow of liquid for ESI was initiated. In all examples, after approximately 1-2 minutes, liquid arrived at the collection rod 12, leading the formation of a liquid cone. Correspondingly, ions were detected in the mass spectrometer after approximately 1-2 minutes. With CsI particles, ions corresponding to $Cs^+$ (m/z=132.9) were detected. For higher deposited masses, $(CsI)Cs^+$ (m/z=392.8), $(CsI)_2Cs^+$ (m/z=652.7), and $(CsI)_3Cs^+$ (m/z=912.6) were also detectable, and are labelled in the integrated mass spectrum in FIG. 4. Also evident in the spectrum is the tetraheptylammonium$^+$ ion (m/z=410.6), which was used earlier for determining the optimal ESI tip position.

Figure 4:
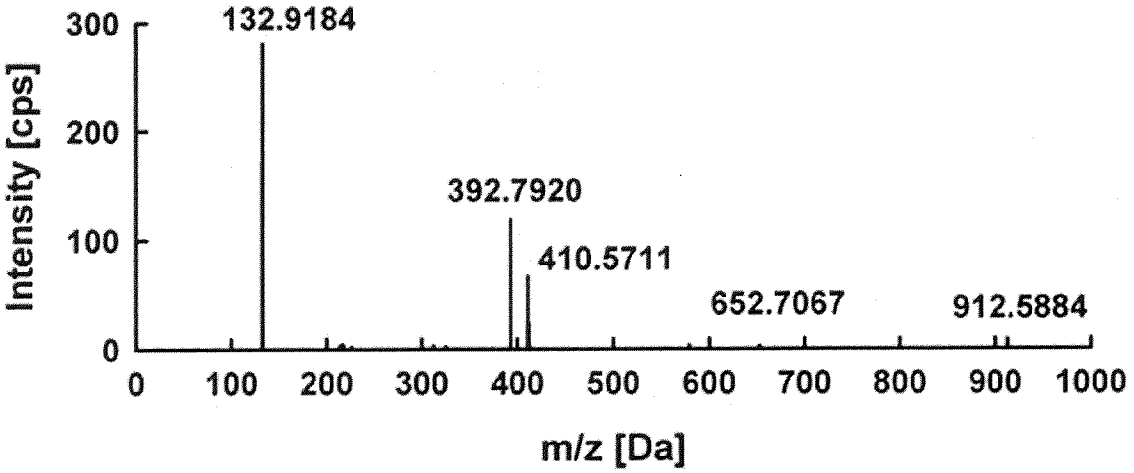
FIG. 4 is a mass spectrum of polydisperse cesium iodide particles deposited for 15 minutes.
Figures 5A, 5B:
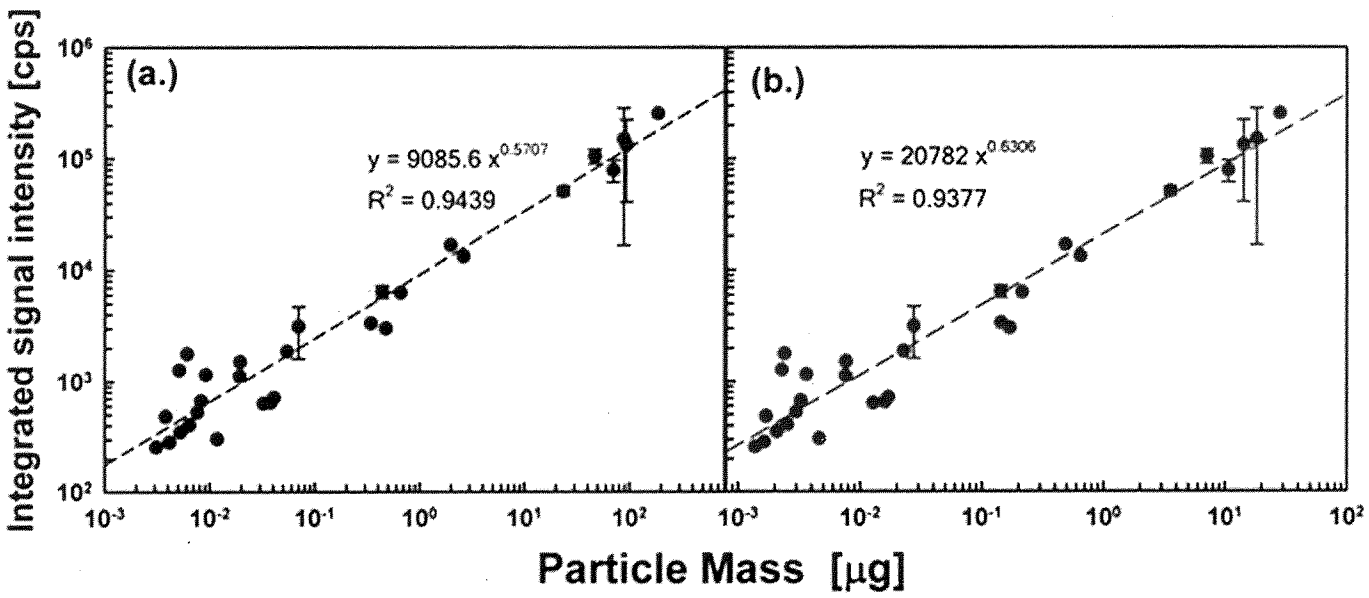
FIG. 5A is a plot of cesium signal intensity as a function of the mass of cesium iodide passed into the ionization chamber.
FIG. 5B is a plot of cesium signal intensity as a function of the mass of cesium iodide deposited on the collection rod.

Qualitatively, the results illustrated in FIG. 4 demonstrate that particles can be collected via electrostatic precipitation and subsequently ESI can be used for chemical analysis. Integrating the signal from all ions containing Cesium (and accounting for multiple Cesium atoms in cluster ions) over the entire experiment yields a total detected cesium concentration. In FIGS. 5A and 5B, the signal intensity is plotted as a function of exposed cesium iodide mass (product of the mass concentration of particles, the flowrate through the nozzle, and the collection time) and the deposited cesium iodide mass (which is corrected for charging and deposition efficiencies, but not for transmission and detection in the mass spectrometer), respectively. Both plots reveal a power law relationship between detected signal and aerosol particle mass over five orders of magnitude, with less than 2 ng of deposited CsI detectable. Regression equations to these results are displayed ($R^2$>0.93), both plots reveal a scaling exponent less than unity (close to 0.6), indicating that as deposited mass increases, the system is less efficient in detecting analytes. Nonetheless, a clear correlation is evident between measured signal and gas phase analyte mass.

Figure 6:
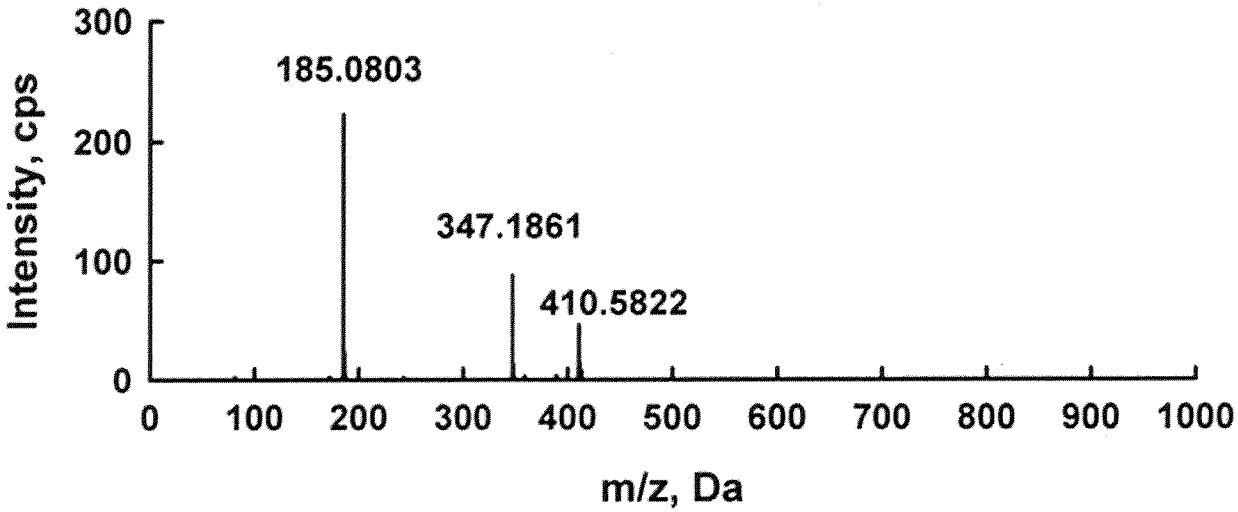
FIG. 6 is a mass spectrum of polydisperse levoglucosan particles deposited for 10 minutes.
Figures 7A, 7B:
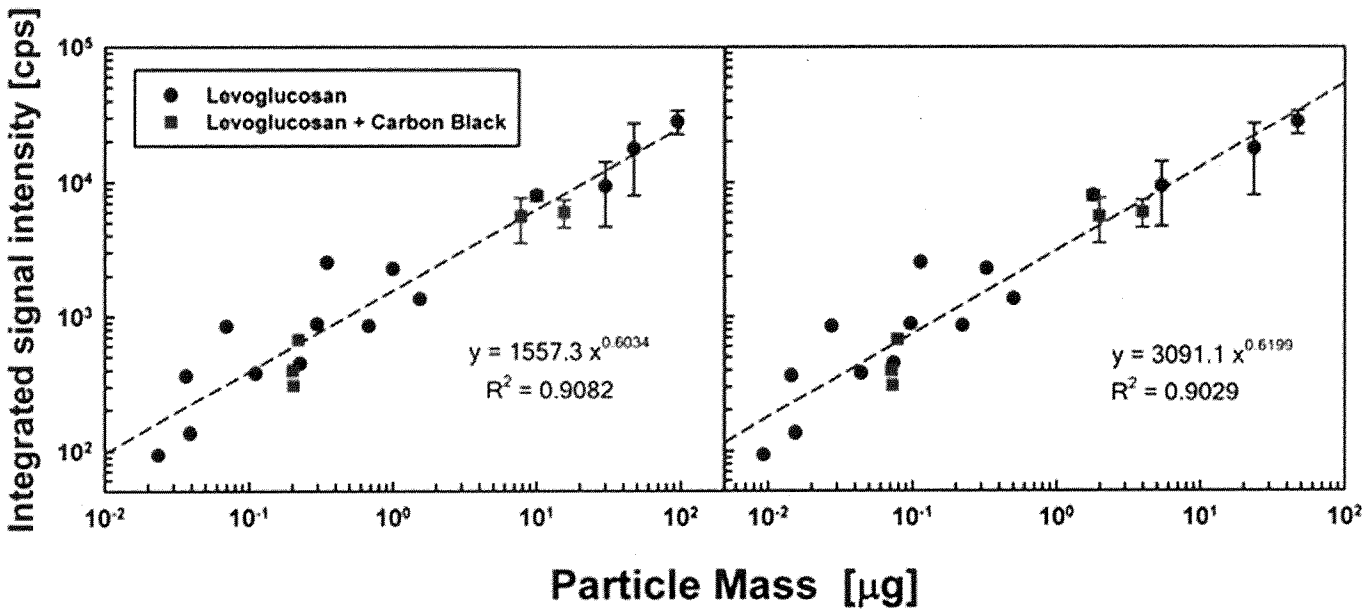
FIG. 7A is a plot of integrated levoglucosan signal intensity from mass spectrometric measurements as a function of the mass of levoglucosan passed into the ionization chamber
FIG. 7B is a plot of integrated levoglucosan signal intensity from mass spectrometric measurements as a function of the mass deposited on the collection rod.

For a polydisperse levoglucosan sample collected for 10 minutes, the integrated mass spectrum is shown in FIG. 6. In the mass spectrum, the levoglucosan+$Na^+$ ion is the dominant species (m/z=185.1), with the sodiated levoglucosan dimer (m/z=347.2) also present. No fragment ions of levoglucosan were detected. Considering both pure levoglucosan particles and levoglucosan mixed with carbon nanoparticles, the integrated levoglucosan signal intensity (again accounting for clusters) is plotted as a function of exposed levoglucosan mass and deposited levoglucosan mass in FIGS. 7A and 7B, respectively. As was found for cesium, these results display a power law relationship between integrated signal and aerosol particle mass, and further reveal that nanogram quantities are detectable with a dynamic range of approximately 4 orders of magnitude in deposited analyte mass. Power law regression again reveals a scaling exponent near 0.6, suggesting this scaling originates from an intrinsic property of the electrospray process or the mass spectrometer employed, as it is found for two very distinct analytes. The levoglucosan-carbon black samples have integrated signals which agree well with the integrated signals for levoglucosan only experiments; no ions were detected which could be attributed to the carbon nanoparticles. However, carbon nanoparticle deposition was apparent from visual examination of the collection rod, suggesting that the presence of these nanoparticles, which are insoluble in water and methanol, did not influence levoglucosan ionization in CAESI process.

The system and technique described throughout this disclosure, referred to as Charged Aerosol ElectroSpray Ionizer (CAESI), is shown to enable analysis of nanogram quantities of collected particles composed of cesium iodide, levoglucosan, and levoglucosan within a carbon nanoparticle matrix. It is further demonstrated that CAESI has a dynamic range of close to 5 orders of magnitude in mass, making it suitable for molecular analysis of aerosol particles in a variety of settings, including laboratory settings with upstream particle size classification, as well as analysis of PM 2.5 particles in ambient air.

Although the present disclosure has been described with reference to preferred embodiments, workers skilled in the art will recognize that changes may be made in form and detail without departing from the spirit and scope of the disclosure.

The invention claimed is:

1. A system for electrospray ionization of species in aerosol particles, comprising:

a source for providing a sample of aerosol particles;

an aerosol deposition apparatus including:

a chamber for electrically charging the sample of aerosol particles; and a nozzle for directing the sample of aerosol particles to an electrospray tip;

a solvent delivery mechanism for delivering a liquid to the electrospray tip; and a high-voltage source for setting the electrospray tip at a high voltage, in order to enable the release of charged droplets carrying dissolved contents of the aerosol particles.

2. The system of claim 1 configured to operate in a switching mode, with the solvent delivery mechanism turned off while the aerosol deposition apparatus is on and vice versa.

3. The system of claim 2, in which polarity of the high-voltage source has the capability of being switched between positive and negative polarities during periods of aerosol deposition being on and off.

4. The system of claim 1, in which the electrospray tip includes a metal rod.

5. The system of claim 4, wherein the nozzle is positioned for aerosol deposition to take place at the tip of the metal rod.

6. The system of claim 4, wherein the nozzle is positioned for aerosol deposition to take place on the metal rod at a point distal from the tip of the rod.

7. The system of claim 6, in which the metal rod is at least partially enclosed in a tube.

8. The system of claim 7 wherein the metal rod diameter is between 0.1 and 10 millimeters.

9. The system of claim 1, and further comprising a mechanism configured to provide the ions that have been released from the charged droplets into a mass spectrometer.

10. A method for electrospray ionization of species in aerosol particles, comprising:

sampling aerosol particles from a gas flow;

applying an electrical charge to the sampled particles;

directing the sampled particles to an electrospray tip and allowing the particles to deposit on the electrospray tip;

delivering a solvent to the electrospray tip for removing the deposited particles from the electrospray tip; and applying a high-voltage to the electrospray tip to release charged droplets carrying dissolved contents of the aerosol particles.

11. The method of claim 10 wherein the steps of allowing the particles to deposit on the electrospray tip and delivering the solvent are performed non-concurrently by operating in a switching mode such that when the particles are depositing on the tip, no liquid solvent is delivered and when liquid solvent is delivered to the tip no particles are being deposited.

12. The method of claim 11, where the polarity of the high-voltage applied to the electrospray tip alternates polarities between a negative polarity applied during periods of aerosol deposition and a positive polarity applied during periods of solvent delivery.

13. The method of claim 10, wherein the electrospray tip includes a metal rod.

14. The method of claim 13, wherein aerosol deposition takes place at the tip of the metal rod.

15. The method of claim 13, wherein aerosol deposition takes place on the metal rod at a point distal from the tip of the rod.

16. The method of claim 15, wherein the metal rod is at least partially enclosed in a tube.

17. The method of claim 14, wherein the metal rod has a diameter between 0.1 and 10 millimeters.

* * * * *